US005417398A

United States Patent [19]

Schilling

[11] Patent Number: 5,417,398

[45] Date of Patent: May 23, 1995

[54] ARTICLE HOLDER

[75] Inventor: Robert D. Schilling, Olmsted Township, Cuyahoga County, Ohio

[73] Assignee: U.S. 261 Corp., Cleveland, Ohio

[21] Appl. No.: 106,857

[22] Filed: Aug. 16, 1993

[51] Int. Cl.[6] ..... A47G 29/00

[52] U.S. Cl. ..... 248/316.5; 248/113; 24/495

[58] Field of Search ..... 248/316.5, 113, 313, 248/316.1, 181, 231.5; 24/495, 500, 598.5; 211/65, 66

[56] References Cited

U.S. PATENT DOCUMENTS

| | | | |
|---|---|---|---|
| 326,225 | 9/1885 | Lavery | 248/113 |
| 641,265 | 1/1900 | Brassington | 24/598.5 |
| 736,831 | 8/1903 | Eidt . | |
| 1,246,492 | 11/1917 | Thiele | 248/113 |
| 1,332,086 | 2/1920 | Van Sickles | 248/316.5 X |
| 1,911,781 | 5/1933 | Wolfe, Jr. . | |
| 1,968,462 | 7/1934 | Merhell | 248/316.5 X |
| 2,379,060 | 6/1945 | Bacheldor | 24/254 |
| 2,666,243 | 1/1954 | Kuehn | 24/598.5 X |
| 2,911,173 | 11/1959 | Deppe | 248/113 |
| 3,013,517 | 12/1961 | Isham | 24/598.5 X |
| 4,909,467 | 3/1990 | Shan-Pao | 248/113 X |
| 5,322,256 | 6/1994 | Kanwischer | 248/113 X |

OTHER PUBLICATIONS

Undated advertisement of Ultra-Hold Canada, Inc., 2 pages, entitled "Get A Firm New Grip On Profits!".

*Primary Examiner*—Karen J. Chotkowski
*Attorney, Agent, or Firm*—Vickers, Daniels & Young

[57] ABSTRACT

A holder for supporting articles such as brooms in suspension comprises a support member for a pair of pivotal arms displaceable towards and away from one another and adapted to receive an article therebetween. The arms have inner ends in the form of balls received in corresponding sockets in the support member, and the arms extend outwardly from the balls through slots provided therefor in the support member. The ball and socket arrangement provides for the arms to pivot relative to the support member in planes which incline downwardly and inwardly relative to a vertical plane between the arms, and about pivot axes which incline upwardly and forwardly and converge toward the vertical plane. Springs interposed between the balls and corresponding sockets bias the arms towards one another.

53 Claims, 3 Drawing Sheets

ARTICLE HOLDER

BACKGROUND OF THE INVENTION

This invention relates to the art of article holders and, more particularly, to improved article holders of the type having pivotal, biased arms for engaging an article therebetween.

A wide variety of devices are available for holding articles such as brooms, shovels and the like in suspension through the use of arms which have a frictional, clamping or wedging engagement with the handle of the article. Such devices heretofore provided include spring-clip type holders having a supporting base and a pair of arms integral therewith and extending forwardly therefrom to receive an article therebetween. An article such as a broom handle introduced between the arms is clampingly engaged therebetween by the resilient spring force of the holder. Accordingly, the ability of such spring-clip holders to adequately support an article depends on the spring biasing force of the arms and the weight of the article. If the article is too heavy relative to the biasing force, the article will slide from between the arms. Other similar devices include arms which are mounted on a support for pivotal displacement about vertical axes and are spring biased towards one another so as to clampingly engage an article therebetween. In addition to the same limitation regarding the ability to support an article based on the weight of the latter and the spring force, these article holders are generally structurally complex and of an undesirably large overall size.

Other devices heretofore provided for holding articles have included cam-cleat devices wherein an eccentric having a serrated outer surface portion is pivotally mounted relative to a fixed abutment or a second serrated eccentric so that displacement of an article or a rope received therebetween in one direction results in a progressively increasing wedging action against the article. This wedging action is advantageous in that it avoids slipping between the article and holder as the weight of the article increases. At the same time, however, the serrated article engaging surfaces have to be spaced apart from one another a distance corresponding to the maximum diameter or thickness of an article to be received therebetween. Accordingly, the pivot axes for the eccentrics have to be even further spaced apart, whereby the overall horizontal space required to accommodate the holder is undesirably large. Expressed another way, the diameter or width of an article which can be held by such a cam-cleat arrangement is less than the space between the support axes for the eccentrics.

SUMMARY OF THE INVENTION

In accordance with the present invention, an improved article holder is provided which minimizes or overcomes the foregoing problems encountered in connection with holders heretofore available. In accordance with one aspect of the invention, a unique pivotal interengagement is provided between the arms and support which enables minimizing the number of component parts for the holder while optimizing structural integrity and promoting longer life for the holder. More particularly in this respect, a holder in accordance with the present invention comprises a pair of arms pivotally associated with a support by a ball and socket arrangement. Such support optimizes the surface area of contact at the pivotal juncture between the parts, thus to promote better distribution of frictional forces therebetween to minimize wear and thus extend the useful life of the holder while promoting structural integrity. Moreover, the ball and socket arrangement eliminates the need for pivot pins and thus promotes ease of assembly and minimizing of the parts required.

In accordance with another aspect of the invention, an article holder comprises a pair of arms associated with a support so as to be pivotal toward and away from one another in corresponding planes which incline downwardly and inwardly relative to a vertical plane between the arms. Expressed another way, the arms are pivotal about corresponding pivot axes which are inclined upwardly and forwardly of the holder and converge toward the vertical plane. The arms are pivotal in their planes and about their axes between fully closed and fully opened positions, and the arms are spring biased toward the closed positions thereof. This pivotal support arrangement for the arms advantageously provides for the engaging force thereof against an article therebetween to progressively increase in response to the weight of the article, thus to provide the advantage of the cam-cleat type holders referred to hereinabove. At the same time, the pivotal support arrangement advantageously provides for the holder to support an article which is larger in diameter or width than the width of the support, thus optimizing the use of available horizontal space for mounting the holders.

Preferably, pivotal support for the foregoing arm displacement is obtained by providing a ball and socket interengagement between the arms and the support of the holder. In a preferred embodiment, this is achieved by providing the support with sockets having spherical surface portions and providing the inner ends of the arms with balls received in the sockets and having spherical surface portions in sliding engagement therewith. Support and guidance for movement of the arms in the planes and about the pivot axes referred to above can be achieved by guide slots in the support opening into the sockets and through which the arms extend and/or by interengaging recess and projection components between the balls and sockets. Preferably, each ball and the corresponding socket are provided with opposed recess portions which together define a spring recess receiving a compression spring by which the corresponding arm is biased toward the closed position thereof. Further in accordance with this preferred arrangement, a projection on the ball extends into the recess portion in the corresponding socket to provide guidance for pivotal movement of the corresponding arm either alone or in combination with the slot through which the arm extends.

The use of a ball and socket arrangement for supporting the arms provides further advantage in conjunction with optimizing the minimum size of the support and thus the overall size of the holder. In this respect, the balls can be provided with flat surface portions enabling the balls to be disposed in the sockets in the support at a centerline distance therebetween which is closer than the diameter of the balls, whereby the width of the support can be less than that which would be required if the full diameter of the balls were utilized for the pivotal support function.

It is accordingly an outstanding object of the present invention to provide an improved article holder of the character comprising pivotally supported arms displaceable toward and away from one another and adapted to receive an article to be supported therebetween.

A further object is the provision of an article holder of the foregoing character comprising arms adapted to receive an article therebetween and supported for pivotal movement toward and away from one another by a ball and socket arrangement between the arms and a support member therefor.

Still a further object is the provision of an article holder of the foregoing character wherein the ball components of the pivotal support are configured to provide for the centers thereof to be closer together than the diameter of the balls.

Another object is the provision of an article holder of the foregoing character in which the arms are uniquely pivotal relative to one another so as to progressively increase the holding force thereof relative to an article in response to an effort to displace the article in the article engaging direction relative thereto.

Yet another object is the provision of an article holder of the foregoing character wherein the arms are pivotal relative to one another in corresponding planes which are inclined and which converge toward a vertical plane between the arms.

A further object is the provision of an article holder of the foregoing character in which the arms are pivotal about corresponding pivot axes which are inclined upwardly and forwardly and converge in the direction of the vertical plane between the arms.

Another object is the provision of an article holder of the foregoing character in which the ball and socket supported arms are displaceable relative to one another so as to progressively increase the wedging engagement thereof with an article therebetween in response to an attempt to displace the article in an article engaging direction relative thereto.

Still another object of the invention is the provision of an article holder of the foregoing character comprised of a minimum number of component parts structured and structurally interrelated so as to minimize the overall dimensions of the holder while promoting the useful life of the holder.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF THE PREFERRED EMBODIMENT

Figure 3:
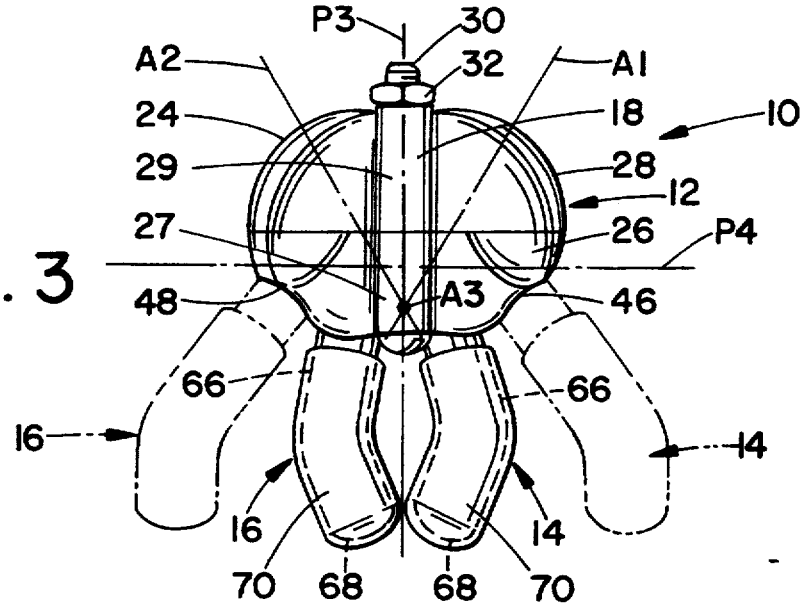
FIG. 3 is a plan view of the holder shown in FIG. 1.

Referring now in greater detail to the drawings wherein the showings are for the purpose of illustrating a preferred embodiment of the invention only and not for the purpose of limiting the invention, an article holder 10 comprises a support 12 and a pair of article engaging arms 14 and 16 interengaged therewith for pivotal displacement relative thereto towards and away from one another as described more fully hereinafter. Support 12 has a top end 18, a bottom end 20, a front end 22 and a rear end 24 and, preferably, is constructed from suitable plastic material such as by molding to provide front and rear support portions 26 and 28, respectively. The top and bottom ends of support portion 26 are provided with integral, apertured bosses 27, and the top and bottom ends of support portion 28 are provided with integral, apertured bosses 29. The apertures through each pair of bosses 27 and 29 are aligned to receive a corresponding threaded bolt 30 and nut 32 by which the support portions are connected together and by which the holder can be mounted on a substrate. Preferably, the front and rear support portions are interlocked in the desired orientation relative to one another by projections 27*a* on bosses 27 and mating recesses 29*a* in bosses 29.

Figure 7:
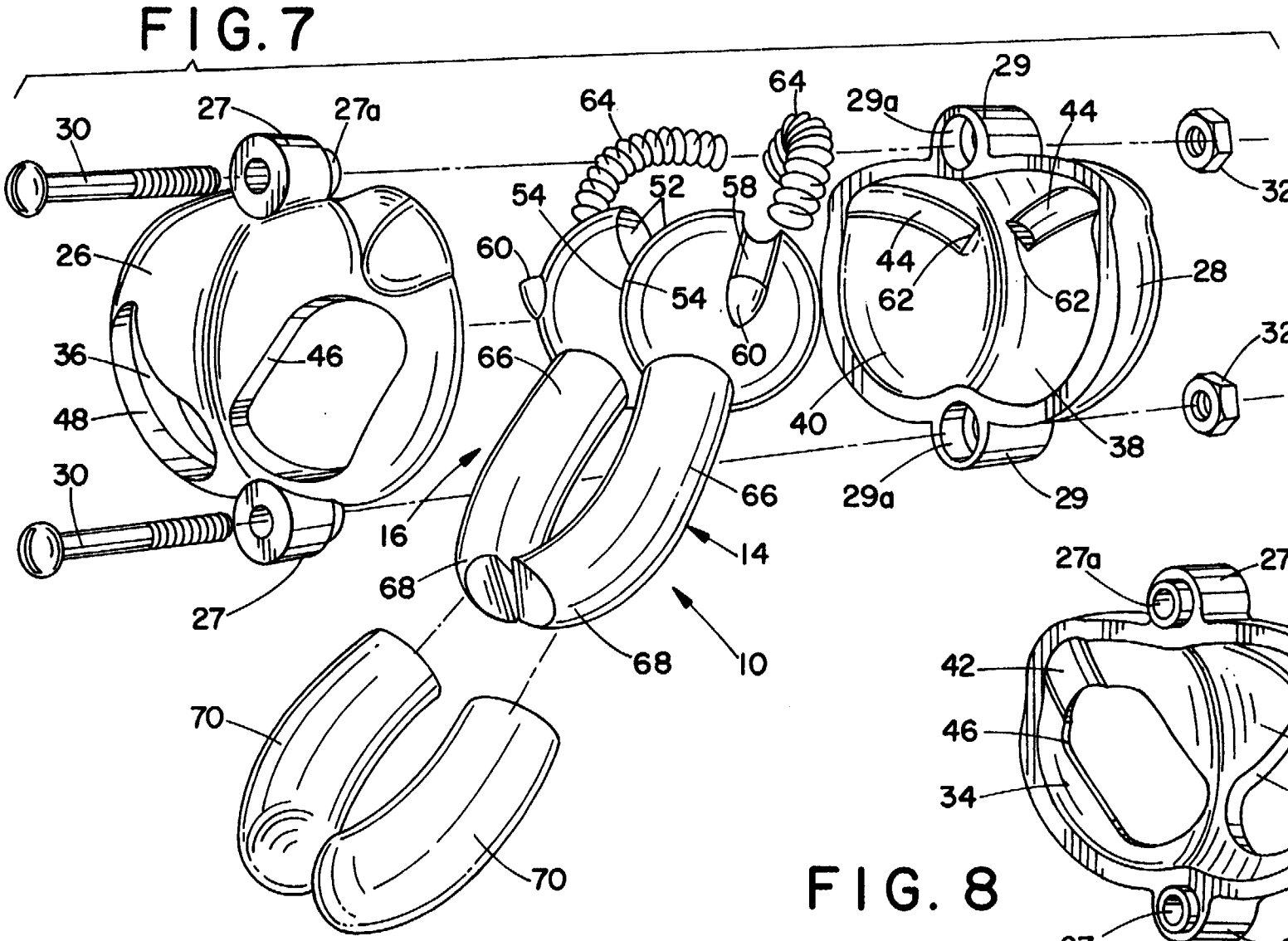
FIG. 7 is an exploded perspective view of the component parts of the holder.
Figure 8:
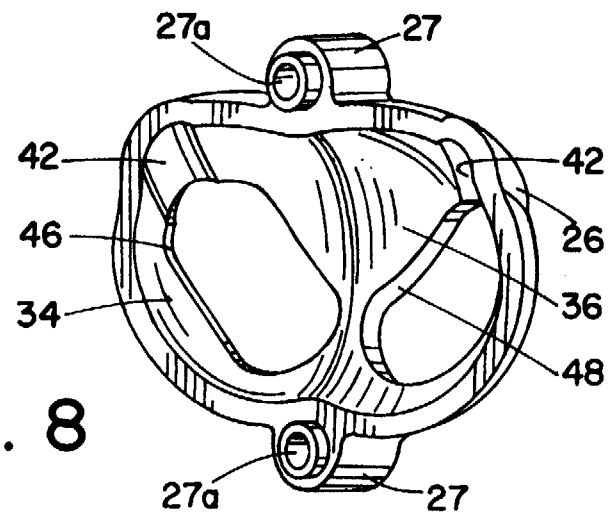
FIG. 8 is a perspective view of the inner side of the front housing portion of the support of the holder.

As best seen in FIGS. 7 and 8 of the drawing, the interior of front support portion 26 is provided with spherical surface portions 34 and 36, and the interior of rear support portion 28 is provided with spherical surface portions 38 and 40. When the support portions are joined together, and for the purpose set forth hereinafter, spherical surface portions 34 and 38 provide a first socket in the support and spherical surface portions 36 and 40 provide a second socket in the support. Each socket portion defined in the interior of front support portion 26 includes a spring receiving recess 42 therein, and each socket portion defined in rear support portion 28 is provided with a spring receiving recess 44 which, when the support halves are joined together, provides a continuation of the corresponding recess 42. Front support portion 26 is provided with first and second slots 46 and 48 which respectively open through the front of the support portion into the first and second sockets described above.

Figure 4:
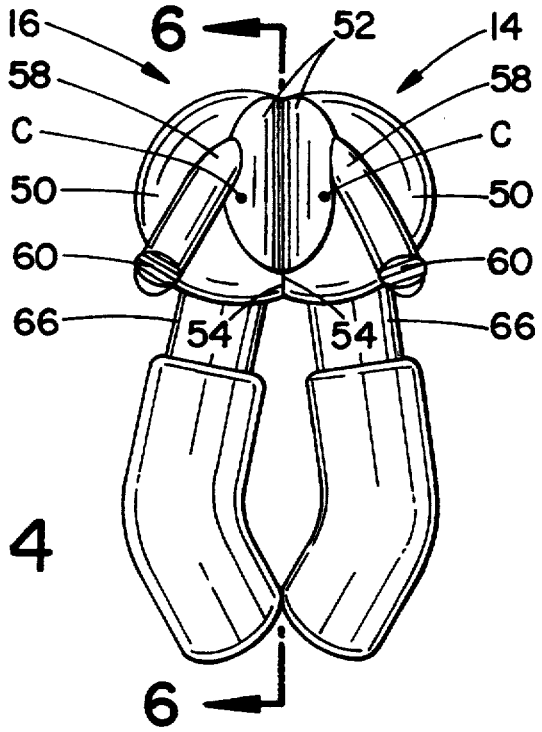
FIG. 4 is a plan view of the arms of the holder shown in the closed position thereof and with the support removed for clarity.
Figure 5:
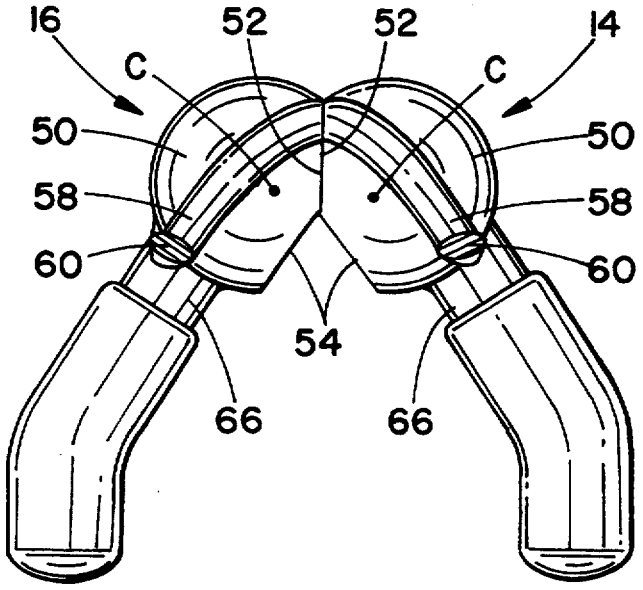
FIG. 5 is a plan view of the arms similar to FIG. 4 and showing the arms in the open position thereof.
Figure 6:
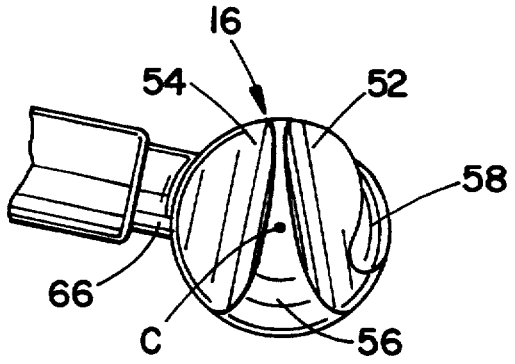
FIG. 6 is an elevation view of one of the arms looking in the direction of line 6—6 in FIG. 4.

In conjunction with the description thus far, arms 14 and 16 respectively define first and second arms, and have balls on the inner ends thereof respectively received in the first and second sockets described above. More particularly, arms 14 and 16 are mirror images of one another and, as best seen in FIGS. 4–6, the ball on the inner end of each arm includes a spherical surface portion 50, a first planar surface 52, a second planar surface 54 at an angle to the corresponding surface 52, and a conical transition surface 56 between the lower ends of the corresponding surfaces 52 and 54. Spherical surface portion 50 of each of the balls has a diameter providing the corresponding ball with a center C. In accordance with the preferred embodiment, the provision of the balls with planar surfaces 52 and 54 advantageously provides for the balls to be pivotally supported in the corresponding sockets in the support with the centers C thereof closer together than the diameter of spherical surface 50. Further, each ball includes a spring recess 58 which, when the balls are received in the corresponding sockets, are radially aligned with spring recesses 42 and 44 in the corresponding socket. A projection 60 extends radially outwardly from spherical surface 50 of each ball adjacent the forward end of the corresponding spring recess 58 and, when the balls and sockets are in assembled relationship, projections 60 are slidably received in the corresponding spring recesses 42 and 44 in the front and rear support portions 26 and 28.

Spring recesses 44 in rear support portion 28 have abutment surfaces 62 at the inner ends thereof, and each arm is adapted to be biased toward the other by a corresponding compression spring 64 received in the corresponding recesses between projection 60 and abutment surface 62 associated therewith. The outer ends of arms 14 and 16 can be of any desired contour and, in the embodiment illustrated, include linear portions 66 extending radially outwardly from the balls through slots 46 and 48 and terminating in outer end portions 68 which curve inwardly toward one another. Preferably, portions 66 and 68 of the legs are provided with rubber or plastic sleeves 70 to optimize frictional interengagement thereof with an article received and supported therebetween.

Figure 1:
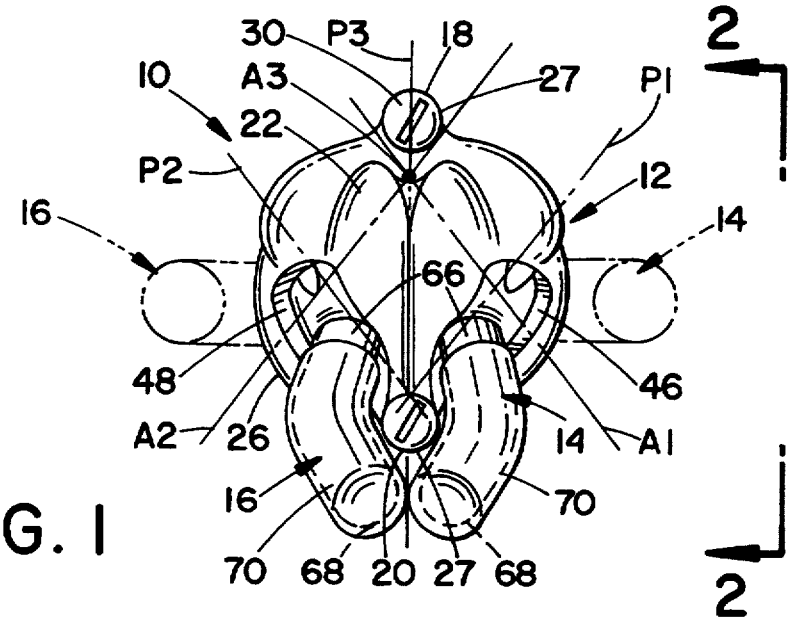
FIG. 1 a front elevation view of an article holder in accordance with the present invention.
Figure 2:
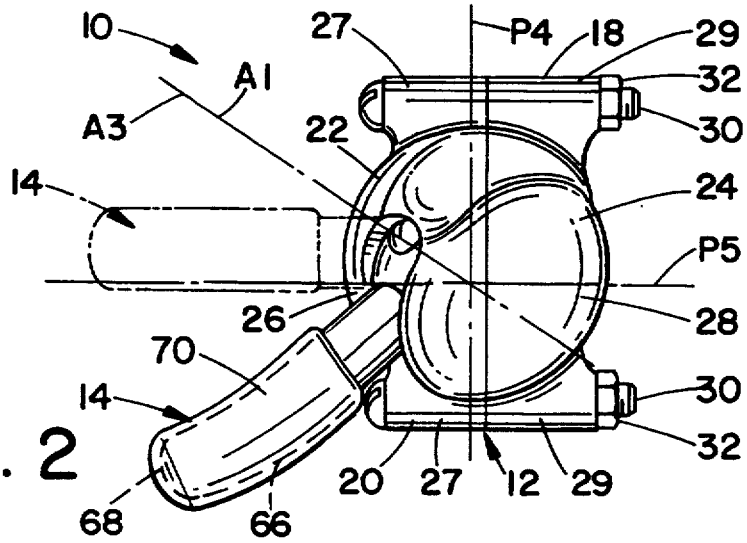
FIG. 2 is a side elevation view of the article holder looking in the direction of line 2—2 in FIG. 1.

It will be appreciated from the foregoing description, and from FIGS. 1–3, that arms 14 and 16 are biased towards one another by springs 64 to a totally closed position as shown by solid lines in the latter figures and are displaceable away from one another against the bias of springs 64 to a fully open position as shown by broken lines in FIGS. 1–3. The relationship between the balls on the inner ends of arms 14 and 16 in the fully closed and fully opened positions thereof is shown respectively in FIGS. 4 and 5 of the drawing. In this respect, when the arms are in the fully closed position, planar surfaces 54 are in opposed generally parallel relationship and may be abutting, and in the fully opened position of the arms, planar surfaces 52 are in opposed generally parallel relationship and may be abutting. The surfaces 54 can abut to limit displacement of the arms in the closing direction and surfaces 52 can abut to limit displacement of the arms in the opening direction. During displacement of the arms from the fully closed toward the fully open positions, the balls pivot relative to one another about their corresponding axes, and the conical transition surfaces 56 thereof together with planar surfaces 52 and 54 provide the geometry necessary to accommodate such pivotal movement without interference between the balls.

As will be appreciated from the foregoing description and from FIGS. 1–3, the ball and socket interengagement provides for arms 14 and 16 to be pivotal relative to support 12 and toward and away from one another in corresponding planes P1 and P2, respectively, which planes incline downwardly and inwardly relative to a vertical plane P3 bisecting legs 14 and 16. Such pivotal support provides for arms 14 and 16 to pivot about axes A1 and A2, respectively, which axes are inclined upwardly and forwardly relative to support 12 and converge inwardly with respect to vertical plane P3. Axes A1 and A2 intersect plane P3 at point A3 which is forwardly of a vertical plane P4 intermediate front and rear ends 22 and 24 of support 12, and above a horizontal plane P5 intermediate top and bottom ends 18 and 20 of the support.

In the preferred embodiment, support and guidance for pivotal movement of arms 14 and 16 in planes P1 and P2 and about axes A1 and A2 is provided by slots 46 and 48 and by the geometry of planar surfaces 52 and 54 and conical surface 56, and by projections 60 on the balls and spring slot portions 42 and 44 in front and back support portions 26 and 28. In particular, arm portions 66 interengage with slots 46 and 48 to guide displacement of the arms in planes P1 and P2 and to preclude pivotal displacement of the balls transverse to axes A1 and A2, and projections 60 interengage with spring recesses 42 and 44 to preclude pivotal displacement of the arms about the axes of arm portions 66. During pivotal displacement of the arms and thus the balls between the open and closed positions of the arms, conical surface portions 56 of the balls are in rolling engagement with one another so as to stabilize the balls and maintain the spherical surfaces 50 thereof closely adjacent the spherical surface portions of the sockets in support portions 26 and 28. It will be appreciated that the axes of rotation A1 and A2 can vary depending on the desired angle of convergence between planes P1 and P2 and thus the arms of the holder and that planar faces 52 and 54 and conical surface 56 are formed on the balls so as to provide the foregoing rolling action between the balls for a given angle of convergence.

As mentioned hereinabove in conjunction with FIGS. 4 and 5 of the drawing, when arms 14 and 16 are in the fully closed position planar surfaces 54 are opposed and parallel to one another, and when the arms are in the fully opened positions thereof planar surfaces 52 are opposed and parallel to one another. Planar surfaces 54 can be in abutting relationship in the closed positions of the arms so as to limit displacement of the arms toward one another, and planar surfaces 52 can be in abutting relationship with one another when the arms are in the fully opened position to limit displacement of the arms away from one another. Alternatively, or in conjunction with the latter, the opposite ends of guide slots 46 and 48 can interengage with arm portions 66 extending therethrough to limit displacement of the arms toward and away from one another. It will be appreciated too that the outer end portions 68 of the arms can be contoured to engage and limit displacement of the arms in the direction toward one another, alone or in conjunction with ball surfaces 54 and/or the lower ends of slots 46 and 48.

It will be appreciated from the foregoing description that, in use, holder 10 is mounted on a suitable vertical substrate so as to be oriented as shown in FIGS. 1–3, and that arms 14 and 16 are pivoted away from one another from the solid line positions toward the broken line positions thereof shown in the latter figures and to the extent necessary to introduce an article such as the handle of a broom therebetween. Movement of arms 14 and 16 away from one another is against the bias of the corresponding spring 64 and, during such movement, the arms progressively diverge as they move in the corresponding one of the planes P1 and P2. Accordingly, when an article to be supported in suspension is disposed between the arms springs 64 bias the arms in the direction of convergence in planes P1 and P2 whereby the force of the arms against the opposite sides of the article is downwardly and inwardly relative thereto. Thus, the downward weight of the article tends to move the arms downwardly and inwardly so as to further constrict the latter relative to the article to preclude slippage of the latter downwardly relative to the holder. An article can readily be introduced between arms 14 and 16 by moving the article upwardly from therebeneath so as to displace the arms upwardly and outwardly away from one another. As soon as the upward movement of the article stops, the constricting action takes place to hold the article, and a downward pull on the article increases the constricting effect. Thus, it will be appreciated that the ability of the holder to support an article is independent of the weight of the latter. The article can be readily removed from the holder by pulling the article horizontally from between the arms.

While considerable emphasis has been placed herein on the structure of and the structural interrelationship between the component parts of the preferred embodiment of the article holder, it will be appreciated that other embodiments as well as modifications of the preferred embodiment can be made without departing from the principles of the present invention. For example, a single spring could be employed for biasing the arms to the closed positions thereof, and such a single spring as well as the pair of springs in the preferred embodiment could be disposed in spring recesses provided entirely in the balls or entirely in the support member rather than partially in each. The latter is preferred for optimizing the total stroke of the arms and the overall size of the holder. If the spring recesses are entirely in the balls, the arm stroke is reduced, and if the spring recesses are entirely in the support, the total stroke is increased but a larger overall size of the assembly is required.

Further, while the support portion of the holder is illustrated herein as having an exterior contour closely corresponding to that of the balls, thus optimizing the use of material in making the support and promoting economy with respect thereto, it will be appreciated that the support portion can be of any desired exterior contour and can be provided with mounting holes or other mounting arrangements for mounting the holder on a substrate. Likewise, the outer ends of the arms can be contoured differently for different applications and can be textured to promote frictional interengagement thereof with an article therebetween. Still further, it will be appreciated that the balls on the inner ends of the arms do not have to be positioned on centerlines closer than their diameters. In such case, pivotal guidance of the arms in the desired inclined planes would be controlled by the guide slots through the front of the support and/or by an interengaging projection and recess guide arrangement between the balls and the support. It will be appreciated, however, that such an arrangement using balls spaced on centerlines spaced apart a distance at least equal to their diameters will increase the minimum spacing between the arms when closed and will increase the overall size of the assembly. Another modification would provide the balls with interengaging teeth on adjacent surfaces thereof such that pivotal movement of one arm would impart pivotal movement to the other. It will be appreciated too that by varying the angle of the axes of rotation of the arms in the preferred embodiment, and thus the angle between the planes in which the arms move, the rate of convergence of the arms can be increased or decreased. In addition to the foregoing possible modifications with respect to the preferred embodiment, it will be appreciated that the same desired angular relationship between the pivot axes of the arms can be achieved other than through the use of a ball and socket arrangement between the support and arms. In this respect, for example, the inner ends of the arms and the support could be pivotally interengaged through the use of pivot pins, or posts on one or the other of the arms and support and post receiving recesses in the other.

The foregoing and other modifications will be obvious or suggested to those skilled in the art from the disclosure of the preferred embodiment herein, whereby it is to be distinctly understood that the foregoing descriptive matter is to be interpreted merely as illustrative of the present invention and not as a limitation.

Having described the invention, the following is claimed:

1. An article holder comprising a support having a front end and top and bottom ends, first and second arms extending outwardly of said front end and adapted to receive an article therebetween, means supporting said first and second arms on said support for pivotal displacement toward and away from one another in corresponding first and second inclined planes, said planes converging in the direction from said top end toward said bottom end, and means biasing said first and second arms towards one another.

2. An article holder according to claim 1, and means to limit displacement of said first and second arms in the direction away from one another.

3. An article holder comprising a support having a front end and top and bottom ends, first and second arms extending outwardly of said front end and adapted to receive an article therebetween, means supporting said first and second arms on said support for pivotal displacement toward and away from one another in corresponding first and second inclined planes, said planes converging in the direction from said top end toward said bottom end, and means biasing said first and second arms towards one another, said means supporting said first and second arms including interengaging ball and socket means on said arms and said support.

4. An article holder according to claim 3, wherein said ball and socket means includes first and second sockets in said support and first and second balls respectively on said first and second arms, said first and second balls being respectively received in said first and second sockets.

5. An article holder according to claim 4, and guide means for guiding displacement of said first and second arms toward and away from one another.

6. An article holder according to claim 5, wherein said guide means includes first and second slots in said support respectively opening into said first and second sockets, said first and second arms respectively extending through said first and second slots.

7. An article holder according to claim 5, wherein said guide means includes slidably interengaging recess and projection means on said first and second balls and said first and second sockets.

8. An article holder according to claim 7, wherein said recess and projection means includes first and second recesses respectively in said first and second sockets, and first and second projections respectively on said first and second balls.

9. An article holder according to claim 8, wherein said guide means includes first and second slots in said support respectively opening into said first and second sockets, said first and second arms respectively extending through said first and second slots.

10. An article holder according to claim 4, wherein said biasing means includes spring means.

11. An article holder according to claim 10, wherein said spring means includes first and second springs respectively between said first and second balls and said support.

12. An article holder according to claim 11, wherein said first socket and said first ball includes first recess means therebetween receiving said first spring and said second socket and said second ball include second recess means therebetween receiving said second spring.

13. An article holder according to claim 12, wherein said first and second recess means respectively receive first and second projection means respectively on said first and second balls to guide displacement of said first and second arms between said open and closed positions.

14. An article holder according to claim 13, wherein said guide means includes first and second slots in said support respectively opening into said first and second sockets, said first and second arms respectively extending through said first and second slots.

15. An article holder according to claim 4, and means to limit displacement of said first and second arms in the direction away from one another.

16. An article holder according to claim 15, wherein said means to limit displacement of said first and second arms includes interengaging stop means on said first and second balls.

17. An article holder according to claim 16, wherein said stop means includes first and second stop surfaces respectively on said first and second balls and facially engaging to limit displacement of said first and second arms.

18. An article holder according to claim 15, wherein said support includes first and second slots opening respectively into said first and second sockets and said first and second arms respectively extend through said first and second slots, said first and second slots having ends engaged by said first and second arms to limit displacement of said arms in the direction away from one another.

19. An article holder according to claim 4, and further including guide means for guiding displacement of said first and second arms toward and away from one another, and means to limit displacement of said first and second arms in the direction away from one another.

20. An article holder according to claim 19, wherein said biasing means includes first and second springs respectively between said first and second balls and said support, said first socket and said first ball including first recess means therebetween receiving said first spring, and said second socket and said second ball including second recess means therebetween receiving said second spring.

21. An article holder according to claim 20, wherein said guide means includes first and second slots in said support respectively opening into said first and second sockets, said first and second arms respectively extending through said first and second slots.

22. An article holder according to claim 21, wherein said first and second recess means respectively receive first and second projection means respectively on said first and second balls to guide displacement of said first and second arms between said open and closed positions.

23. An article holder according to claim 22,and means to limit displacement of said first and second arms in the direction away from one another.

24. An article holder according to claim 23, wherein said first and second slots have ends engaged by said first and second arms to limit displacement of said arms in the direction from said closed to said open position.

25. An article holder according to claim 1 and guide means for guiding displacement of said first and second arms between said open and closed positions.

26. An article holder comprising a support having a front end, a back end and top and bottom ends, horizontally opposed first and second arms extending outwardly of said front end and adapted to receive an article therebetween, means supporting said first and second arms on said support for pivotal displacement toward and away from one another and respectively about first and second axes, said axes being inclined upwardly and forwardly and converging relative to a vertical plane between said first and second arms, and biasing means biasing said arms toward one another.

27. An article holder according to claim 26, wherein said first and second axes intersect in said vertical plane at a point spaced forwardly from a vertical plane intermediate said first and back ends.

28. An article holder according to claim 27, wherein said point is spaced above a horizontal plane intermediate said top and bottom ends.

29. An article holder according to claim 26, wherein said first and second arms have inner ends in said support, and said biasing means includes spring means between said inner ends.

30. An article holder according to claim 29, wherein said arms and said support include means interengaging to guide displacement of said arms toward and away from one another.

31. An article holder according to claim 26, wherein said arms are adapted to move toward one another to a closed position and away from one another to an open position, said arms in said closed position being inclined relative to horizontal and in moving from said closed toward said open position progressively approaching a horizontal position.

32. An article holder according to claim 31, wherein said arms in said closed position are inclined downwardly relative to horizontal.

33. An article holder comprising a support, first and second arms adapted to receive an article therebetween, said arms and said support including interengaging ball and socket means supporting said arms for pivotal displacement toward and away from one another relative to said support, and means biasing said arms toward one another, said ball and socket means including first and second socket means in said support and first and second ball means respectively in said first and second socket means and respectively on said first and second arms.

34. An article holder according to claim 33, wherein said ball and socket means include means interengaging to guide said pivotal displacement of said arms.

35. An article holder according to claim 33, wherein said support and said arms include means interengaging to guide said pivotal displacement of said arms.

36. An article holder according to claim 33, wherein said support and said arms include means interengaging to limit displacement of said arms away from one another.

37. An article holder according to claim 33, wherein said arms include means interengaging to limit displacement of said arms away from one another.

38. An article holder according to claim 33, wherein each said ball means includes first and second surface portions, said first surface portion being spherical and having a diameter providing each said ball means with a center, and said second surface portion providing for said first and second ball means to be positioned in said socket means with the center distance therebetween less than said diameter.

39. An article holder according to claim 38, wherein said second surface portion of said first and second ball means includes first and second planar surfaces disposed at an angle to one another, said first and second planar surfaces of said first ball means respectively pivoting toward said first and away from said second planar surface of said second ball means during displacement of said arms away from one another.

40. An article holder according to claim 39, wherein said arms are adapted to move away from one another to a fully open position and towards one another to a fully closed position, said first planar surfaces being opposed and parallel in said fully open position and said second planar surfaces being opposed and parallel in said fully closed position.

41. An article holder according to claim 40, wherein said second surface portion of each said first and second ball means further includes conical transition surface means between the first and second planar surfaces thereof.

42. An article holder according to claim 39, wherein said second surface portion of each said first and second ball means further includes conical transition surface means between the first and second planar surfaces thereof.

43. An article holder according to claim 33, wherein each said first and second ball means includes a spherical surface in the corresponding socket means and said corresponding socket means includes a socket surface slidably interengaging with said spherical surface, and said means biasing said arms includes spring recess means in at least one of said spherical and socket surfaces, and biasing spring means in said recess means.

44. An article holder according to claim 43, wherein said recess means includes opposed recesses in said spherical and socket surfaces of each said first and second ball means and socket means, each said recess in said socket surfaces and the opposed recess in said spherical surfaces having opposed spring abutment ends, and a compression spring in said opposed recesses between said abutment ends.

45. An article holder according to claim 44, and a projection extending outwardly from said spherical surface at said abutment end of said recess therein, said projection extending into said opposed recess in said socket surface and interengaging therewith to preclude displacement of said spherical surface relative to said socket surface transverse to the direction between said abutment ends.

46. An article holder according to claim 33, wherein said support includes arm guiding 1 slot means opening into said-first and second socket means, said first and second arm means extending through said slot means from said first and second ball means and interengaging with said slot means to guide displacement of said arms toward and away from one another.

47. An article holder according to claim 46, wherein said slot means has ends engaged by said first and second arms to limit displacement thereof away from one another.

48. An article holder according to claim 33, wherein each said first and second ball means includes first and second surface portions, said first surface portion being spherical and having a diameter providing each said ball means with a center, said second surface portion providing for said first and second ball means to be positioned in said socket means with the center distance therebetween less than said diameter, each said first and second ball means including a spherical surface in the corresponding socket means, said corresponding socket means including a socket surface slidably interengaging with said spherical surface, and said means biasing said arms including spring recess means in at least one of said spherical and socket surfaces, and biasing spring means in said recess means.

49. An article holder according to claim 48, wherein said support includes arm guiding slot means opening into said first and second socket means, said first and second arm means extending through said slot means from said first and second ball means and interengaging with said slot means to guide displacement of said arms toward and away from one another.

50. An article holder according to claim 48, wherein said second surface portion of said first and second ball means includes first and second planar surfaces disposed at an angle to one another, said first and second planar surfaces of said first ball means respectively pivoting toward said first and away from said second planar surface of said second ball means during displacement of said arms away from one another and wherein said second surface portion of each said first and second ball means further includes conical transition surface means between the first and second planar surfaces thereof.

51. An article holder according to claim 50, wherein said support includes arm guiding slot means opposing into said first and second socket means, said first and second arm means extending through said slot means from said first and second ball means and interengaging with said slot means to guide displacement of said arms toward and away from one another.

52. An article holder according to claim 51, wherein said spring recess means includes opposed recesses in said spherical and socket surfaces of each said first and second ball means and socket means, each said recess in said socket surfaces and the opposed recess in said spherical surfaces having opposed spring abutment ends, a compression spring in said opposed recesses between said abutment ends, and a projection extending outwardly from said spherical surface at said abutment end of said recess therein, said projection extending into said opposed recess in said socket surface and interengaging therewith to preclude displacement of said spherical surface relative to said socket surface transverse to the direction between said abutment ends.

53. An article holder according to claim 52, wherein said slot means has ends engaged by said first and second arms to limit displacement thereof away from one another.

* * * * *